United States Patent [19]

Tate

[11] Patent Number: 4,598,615

[45] Date of Patent: Jul. 8, 1986

[54] ADJUSTABLE WRENCH

[76] Inventor: Bernell G. Tate, Rte. 6, Box 237B, Tupelo, Miss. 38801

[21] Appl. No.: 690,945

[22] Filed: Jan. 11, 1985

[51] Int. Cl.[4] ..... B25B 13/52

[52] U.S. Cl. ..... 81/64; 81/3.43; 81/65.2

[58] Field of Search ..... 81/64, 68, 69, 3.43, 81/65.2

[56] References Cited

U.S. PATENT DOCUMENTS

| | | | |
|---|---|---|---|
| 1,143,126 | 6/1915 | Martin | 81/65.2 |
| 3,838,615 | 10/1974 | McFarland et al. | 81/64 |
| 4,095,492 | 6/1978 | Makela | 81/3.43 |
| 4,114,481 | 9/1978 | Kowalczyk | 81/64 |
| 4,145,938 | 3/1979 | Laird | 81/64 |
| 4,307,633 | 12/1981 | Leonard et al. | 81/64 |

*Primary Examiner*—Frederick R. Schmidt
*Assistant Examiner*—J. T. Zatarga
*Attorney, Agent, or Firm*—Walker & McKenzie

[57] ABSTRACT

An adjustable wrench for use in rotating screw-on oil filters and the like. The wrench has a strap for encircling the filter, and a lever for tightening the strap about the filter. The lever has a first end attached to a first end of the strap, an intermediate portion attached to the second end of the strap, and a second end for movement between a first position in which the strap is loose about the filter and a second position in which the strap is tight about the filter. The second end of the lever being located substantially at the center of a circle defined by the strap when in the second position.

9 Claims, 12 Drawing Figures

ADJUSTABLE WRENCH

BACKGROUND OF THE INVENTION

1. Field of the Invention

The present invention relates to tools for use in rotating a workpiece such as a typical screw-on type oil filter of an internal combustion motor or the like.

2. Description of the Prior Art

Various tools have heretofore been developed for use in rotating a typical screw-on cartridge type oil filter or the like. One such tool consists of an adjustable wrench including a belt B for encircling the filter, and including a lever L coupled to the opposite ends of the belt B in such a manner that initial pivotal movement of the lever L will tighten the belt B about the filter and subsequent pivotal movement of the lever L will cause the filter to rotate (see FIGS. 11 and 12). The lever L may consist of an elongated handle H extending radially outward from the belt B for allowing the user of the wrench to manually grip and rotate the handle H (see FIG. 11), or may consist of an elongated plate P having a socket S or the like mounted thereon for allowing the user of the wrench to utilize a tool such as a typical socket wrench to rotate the lever L (see FIG. 12). Such belt/lever type filter wrenches have certain advantages over other prior art type filter wrenches of the fixed size or spring-clamp type in that, for example, such belt/lever type filter wrenches provide secure gripping of the filter regardless of small variances in the diameter of the filter, etc. However, such prior art belt/lever type filter wrenches are disadvantageous in that, in operation, the lever L thereof must be moved through an arc A (see FIGS. 11 and 12) that is spaced radially outward from the longitudinal axis of the filter thus often creating interference with structure that may be located radially adjacent the filter when the filter is attached to the motor block or the like. The present invention is not disclosed or suggested by any known prior art.

SUMMARY OF THE INVENTION

The present invention provides an improved adjustable wrench of the belt/lever type. The concept of the present invention is to provide such an adjustable wrench in which the required rotational movement of the lever portion of the wrench to rotate the filter or workpiece is substantially aligned with the longitudinal axis of the workpiece.

The adjustable wrench of the present invention includes, in general, an elongated lever having a first end, a second end, and an intermediate portion between the first and second ends; and an elongated, flexible body defining a circle for encircling the second or outer end of a workpiece, the body having a first end attached to the first end of the lever and having a second end attached to the intermediate portion of the lever, the lever being movable between a first or open position in which the second end of the lever is located a spaced distance from the center of the circle defined by the body and a second or closed position in which the second end of the lever is located substantially at the center of the circle defined by the body, the band tightly engaging the workpiece when the lever is in the second position.

DESCRIPTION OF THE PREFERRED EMBODIMENT

Figure 10:
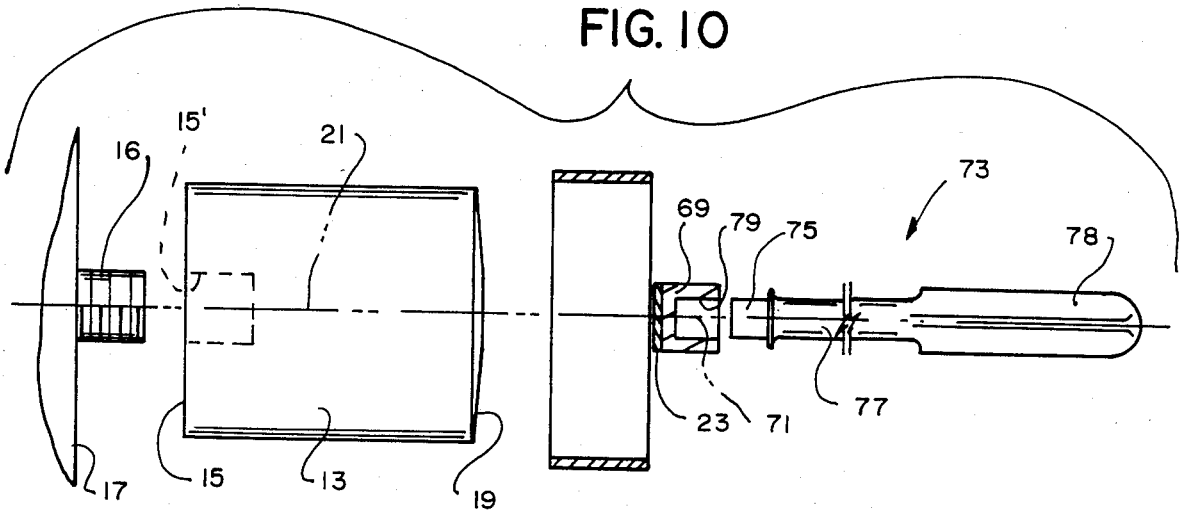
FIG. 10 is an exploded view showing the adjustable wrench of the present invention in relation to a filter, a motor block and an auxiliary tool.

The adjustable wrench 11 of the present invention is for use in rotating a workpiece such as a typical screw-on oil filter 13 or the like having a first end 15 with a threaded cavity 15' for being screwed onto a support such as a threaded boss portion 16 of the block 17 of an internal combustion motor or the like, a second end 19 directed away from the block 17, and a longitudinal axis 21 extending between the first and second ends 15, 19 (see, in general FIG. 10). Thus, as will be apparent to those skilled in the art, rotation of the filter 13 about the longitudinal axis 21 is effective to screw the first end 15 thereof onto or off of the boss portion 16 on the block 17. The wrench 11 is especially adapted to aid in screwing the filter 13 off of the block 17.

The wrench 11 includes an elongated lever 23 having a first end 25, a second 27, and an intermediate portion 29 between the first and second ends 25, 27 (see, in general, FIGS. 1–4). The lever 23 may consist simply of a rigid, elongated metal plate having a first aperture 31 through the first end 25 thereof and having a second aperture 33 through the intermediate portion 29 thereof a spaced distance from the first aperture 31 for reasons which will hereinafter become apparent.

The wrench 11 includes an elongated, flexible body 35 for defining a circle for encircling the second end 19 of the filter (see, in general, FIGS. 1–4). The body 35 has a first end 37 attached to the first end 25 of the lever 23 and has a second end 39 attached to the intermediate portion 29 of the lever 23. The body 35 may be constructed of an elongated metal strap or belt having a first edge 41 and a second edge 43. An aperture 45 is preferably provided through the first end 37 of the body 35 extending between the first and second edges 41, 43 thereof, and an aperture 47 is preferably provided through the second end 39 of the body 35 extending between the first and second edges 41, 43 thereof for reasons which will hereinafter become apparent. The first end 37 of the body 35 may merely be turned back on itself to form the aperture 45 therethrough and to reinforce the body 35. Thus, the turned back portion of the first end 37 of the body 35 may be spot welded or otherwise fixedly attached to the adjacent part of the body 35 as will be apparent to those skilled in the art. A slot 48 may be provided in the first end 37 as clearly shown in FIG. 1. The second end 39 of the body 35 may have a reinforcing plate 49 attached thereto to reinforce the body 35. Thus, the reinforcing plate 49 may consist simply of a length of the same material which the remainder of the body 35 is constructed of and may be spot welded or otherwise fixedly attached to the adjacent portions of the body 35. The aperture 47 may be formed by the reinforcing plate 49 in any manner now apparent to those skilled in the art such as, for example, by way of a bend being formed in the reinforcing plate 49 as clearly shown in the drawings. The aperture 47 in the second end 39 of the body 35 may thus be located a short distance rearwardly of the distal end thereof as shown in the drawings. The bend is preferably provided only adjacent the edges of the plate 49 with the midportion thereof flatened so as to, in effect, define a slot 50 as clearly shown in FIG. 1.

The wrench 11 preferably includes a first pivot means 51 for pivotally attaching the first end 37 of the body to the first end 25 of the lever. The first pivot means 51 preferably includes a pivot rod 53 for being received in the aperture 45 in the first end 37 of the body 35 and in the first aperture 31 in the first end 25 of the lever 23.

The wrench 11 also preferably includes a second pivot means 55 for pivotally attaching the second end 39 of the body 35 to the intermediate portion 29 of the lever 23. The second pivot means 55 preferably includes a pivot rod 57 for being received in the aperture 47 in the second end 39 of the body 35 and in the second aperture 33 through the intermediate portion 29 of the lever 23.

The wrench 11 preferably includes an elongated plate 59 having a first end 61 for being attached to the first end 37 of the body 35 and a second end 63 for being attached to the second end 39 of the body 35. The plate 59 preferably has a first aperture 65 through the first end 61 thereof for receiving the pivot rod 53 of the first pivot means 51, and preferably has a second aperture 67 through the second end 63 thereof for receiving the pivot rod 57 of the second pivot means 55. The distance between the first and second apertures 65, 67 of the plate 59 is preferably substantially equal to the distance between the first and second apertures 31, 33 through the lever 23.

Figure 1:
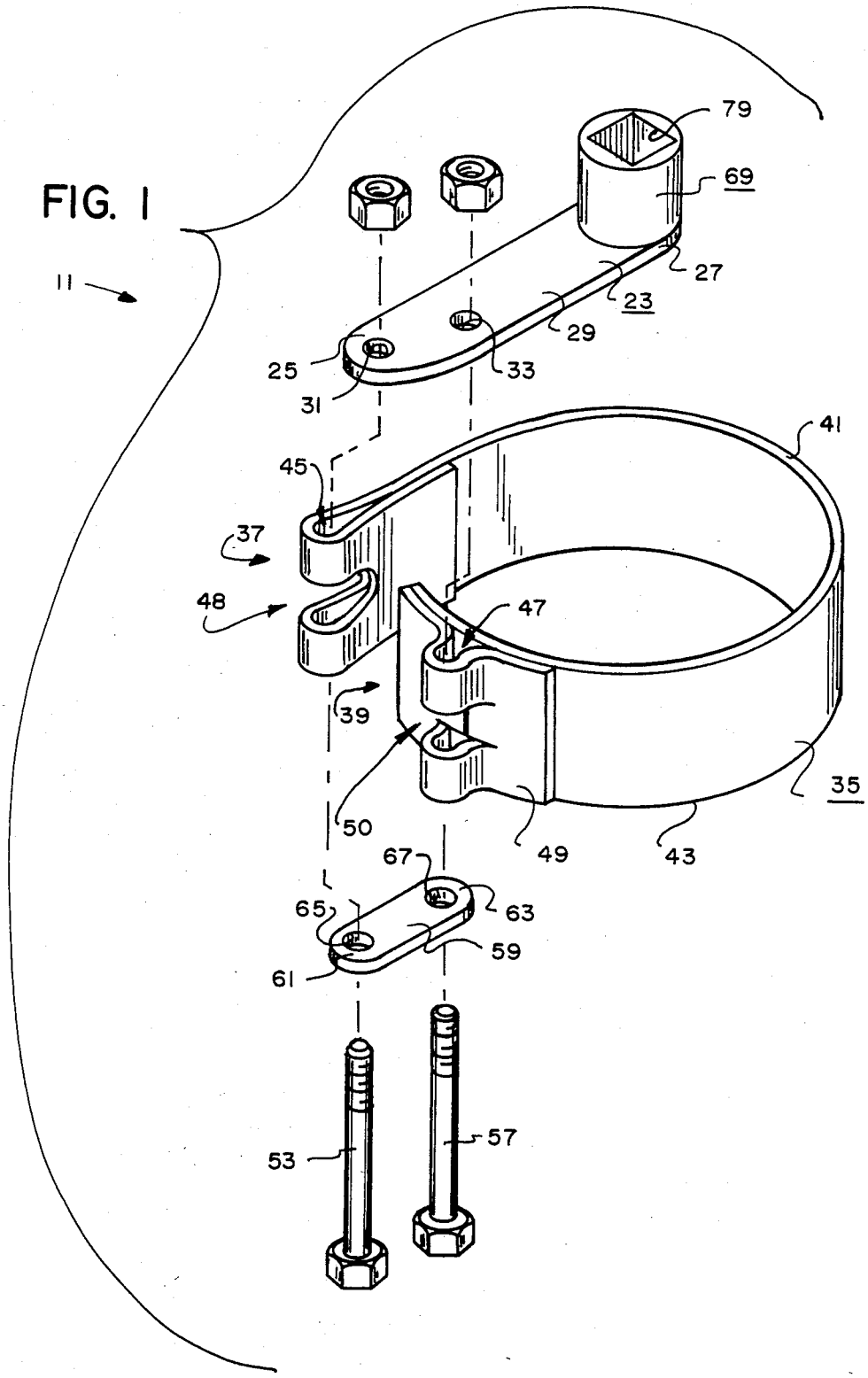
FIG. 1 is an exploded perspective view of the adjustable wrench of the present invention.
Figure 2:
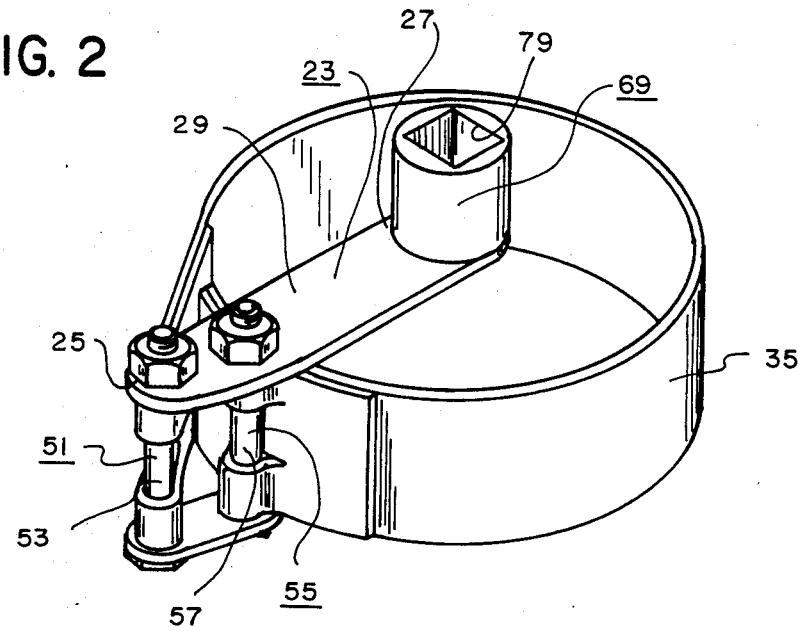
FIG. 2 is a perspective view of the adjustable wrench of the present invention.
Figure 3:
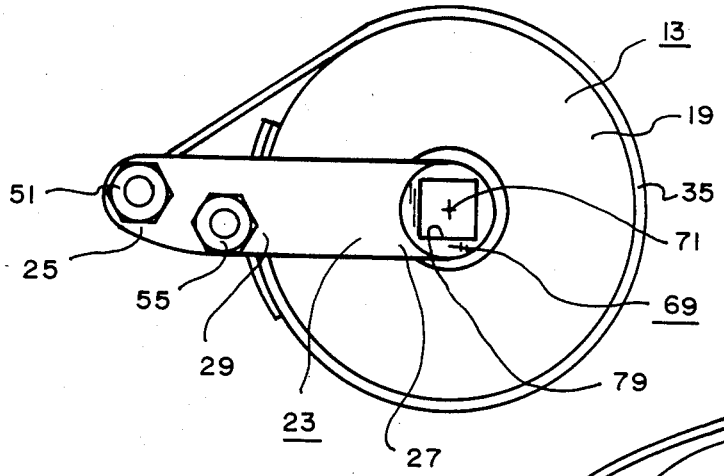
FIG. 3 is a plan view of the adjustable wrench of the present invention shown mounted on a filter and with the lever in the closed position.
Figure 4:
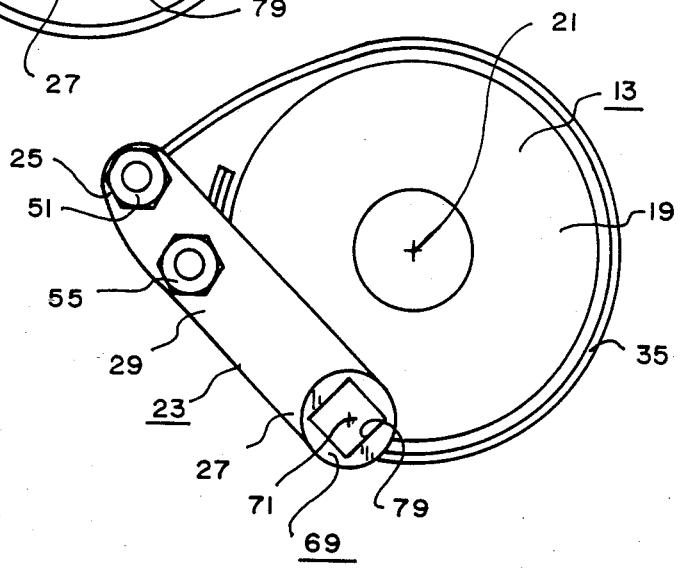
FIG. 4 is a plan view similar to FIG. 3 but with the lever in the open position.
Figure 5:
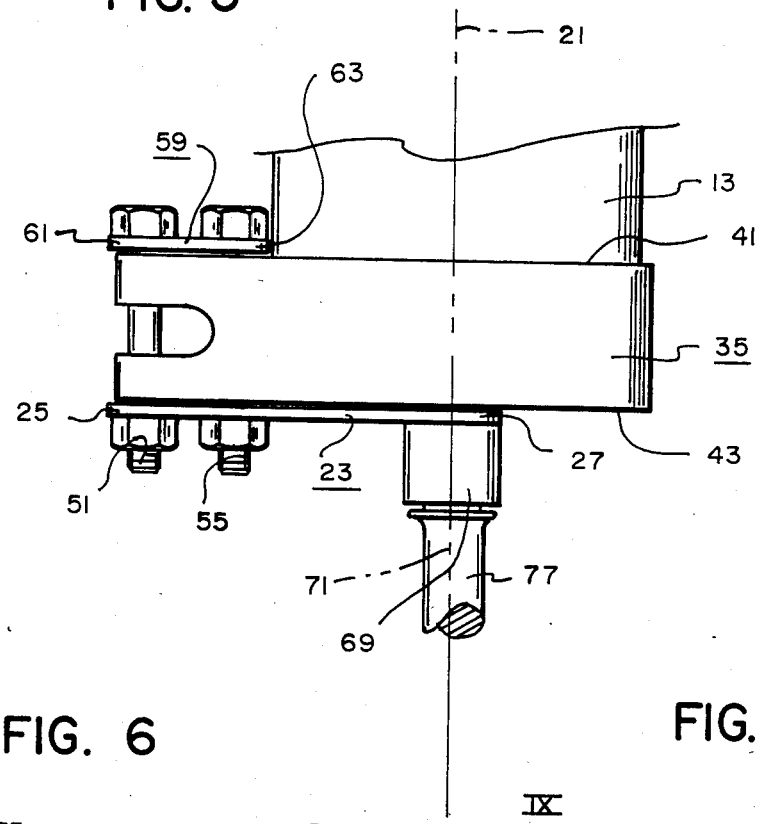
FIG. 5 is an elevational view of the adjustable wrench of the present invention shown mounted on a filter and with an auxiliary tool attached thereto.
Figure 6:
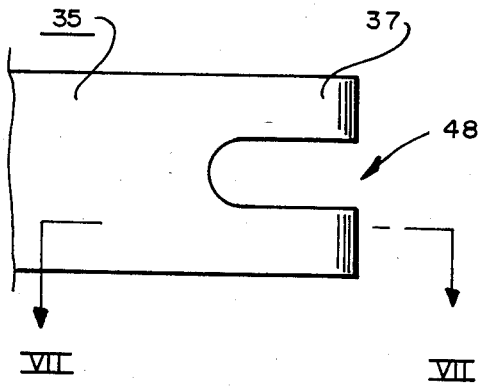
FIG. 6 is an elevational view of a first end of the elongated body of the adjustable wrench of the present invention.
Figure 8:
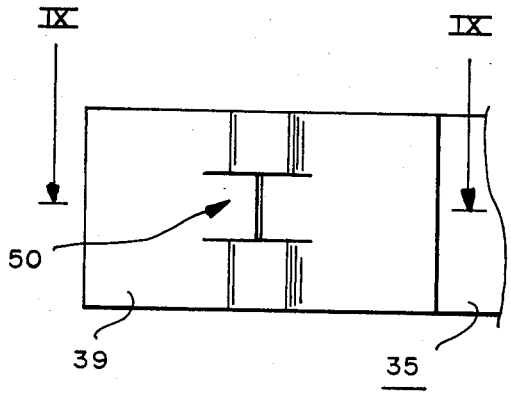
FIG. 8 is an elevational view of a second end of the elongated body of the adjustable wrench of the present invention.
Figure 9:
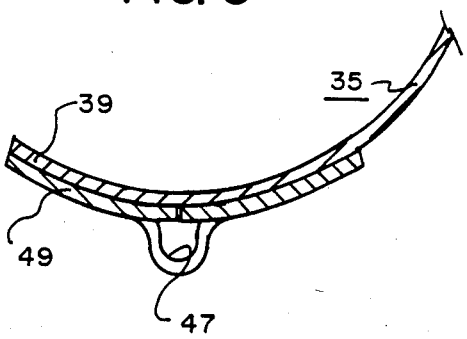
FIG. 9 is a sectional view as taken on line IX—IX of FIG. 8.
Figure 7:
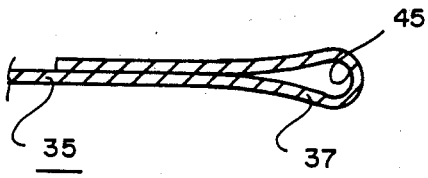
FIG. 7 is a sectional view as taken on line VII—VII of FIG. 6.

The first and second pivot means 51, 55 preferably consist of substantially typical bolt means for extending through the respective apertures in the lever 23, body 35 and plate 59 to pivotally and securely couple the lever 23, body 35 and plate 59 to one another as clearly shown in FIGS. 2 and 5 with the lever 23 attached to the body 35 adjacent the first edge 41 thereof and with the plate 59 attached to the body 35 adjacent the second edge 43 thereof.

The wrench 11 preferably includes an activating means 69 attached to the second end 27 of the lever 23 for use in moving the lever 23 between a first or open position in which the second end 27 of the lever 23 is located a spaced distance from the center of the circle defined by the body 35 and a second or closed position in which the second end 27 of the lever 23 is located substantially at the center of the circle defined by the body 35. The body is sized so as to tightly engage the filter 13 when the lever 23 is in the second position as will now be apparent to those skilled in the art. The activating means 69 preferably has a longitudinal axis 71 which becomes substantially aligned with the longitudinal axis 21 of the filter 13 when the lever 23 is moved to the second position whereby rotation of the activating means 69 about the longitudinal axis 71 thereof when the lever 23 is in the second position will cause the filter 13 to rotate about the longitudinal axis 21 thereof. The wrench 11 is preferably for use with an auxiliary tool 73 of the type having a head portion 75, an elongated neck portion 77 extending from the head portion 75, and a handle 78 attached to the neck portion 77 (see FIG. 10). Thus, the auxiliary tool 73 may consist of a typical socket wrench having an extension member thereon as will now be apparent to those skilled in the art. The activating means 69 preferably has a socket 79 for receiving the head portion 75 of the auxiliary tool 73 and for holding the neck portion 77 of the auxiliary tool 73 substantially aligned with the longitudinal axis 71 of the activating means 69 when the head portion 75 is received by the socket 79. The activating means 69 may consist of a typical socket member welded or otherwise fixedly attached to the second end 27 of the lever 23 as will now be apparent to those skilled in the art.

To use the wrench 11 to rotate the filter 13 in removing the filter 13 from the block 17 or the like, the body 35 is merely placed over the second end 19 of the filter 13 with the lever 23 in the first position. The head portion 75 of the auxiliary tool 73 is inserted into the socket 79 of the activating means 69 and the auxiliary tool 73 can then be pivoted to move the lever 23 to the second position causing the band 35 to tightly grip the filter 13. Subsequent rotation of the neck portion 77 of the auxiliary tool 73 will cause the activating means 69 to rotate about the longitudinal axis 71 and will thus cause the filter 13 to rotate about the longitudinal axis 23, thereby allowing the filter 13 to be screwed off of the block 17 as will now be apparent to those skilled in the art.

Figure 11:
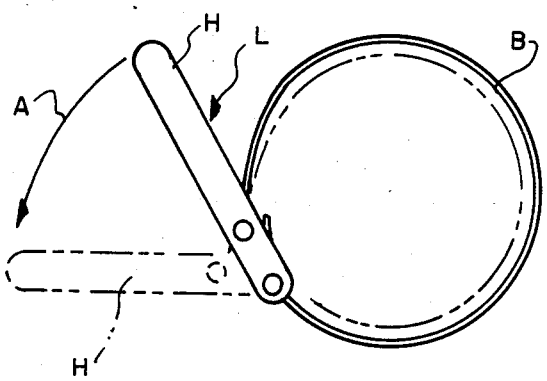
FIG. 11 (PRIOR ART)
FIGS. 11 and 12 are plan views of prior art adjustable wrenches of the belt/lever type.
Figure 12:
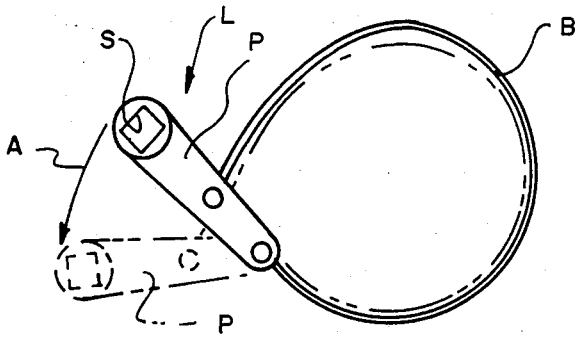
FIG. 12 (PRIOR ART)

As thus constructed and used, the present invention provides an adjustable wrench for use in rotating screw-on oil filters and the like which provides all the advantages of prior belt/lever type filter wrenches and the like (e.g., secure gripping of the filter regardless of small variances in the diameter of the filter, etc.) while not creating interference with any structure that may be located radially adjacent the filter when the filter is attached to a motor block or the like since the necessary rotational movement of the wrench of the present invention to rotate the filter is applied through a point (i.e., the second end 27 of the lever 23) that is aligned with the longitudinal axis of the filter rather than through an arc that is spaced radially outward from the longitudinal axis of the filter such as required by the prior art belt/lever type filter wrenches (see, e.g., FIGS. 11 and 12).

Although the present invention has been described and illustrated with respect to a preferred embodiment thereof and a preferred use therefore, it is not to be so limited since changes and modifications can be made therein which are within the full intended scope of the invention.

I claim:

1. An adjustable wrench for use with an auxiliary tool having a head portion and having an elongated neck portion extending from said head portion to rotate a screw-on type filter having a first end for being screwed onto a support portion of an internal combustion engine, having a second end directed away from said support portion, and having a longitudinal axis extending between said first and second ends, rotation of said filter about said longitudinal axis being effective to screw said first end thereof onto or off of said support portion, said wrench comprising:

(a) an elongated lever having a first end, a second end, and an intermediate portion between said first and second ends;

(b) an elongated, flexible body defining a circle for encircling said second end of said filter, said body having a first end attached to said first end of said lever and having a second end attached to said intermediate portion of said lever, said lever being movable between a first position in which said second end of said lever is located a spaced distance from the center of said circle defined by said body and a second position in which said second end of said lever is located substantially at the center of said circle defined by said body, said body tightly engaging said filter when said lever is in said second position; and (c) activating means attached to said second end of said lever for use in moving said lever between said first and second positions, said activating means having a longitudinal axis, said longitudinal axis of said activating means being substantially aligned with said longitudinal axis of said filter when said lever is in said second position, rotation of said activating means about said longitudinal axis thereof when said lever is in said second position causing said filter to rotate about said longitudinal axis thereof, said activating means having a socket for receiving said head portion of said auxiliary tool substantially aligned with said longitudinal axis of said activating means.

2. The wrench of claim 1 in which is included a first pivot means for pivotally attaching said first end of said body to said first end of said lever, and in which is included a second pivot means for pivotally attaching said second end of said body to said intermediate portion of said lever.

3. The wrench of claim 2 in which said body has a first edge and a second edge, said lever being attached to said body adjacent said first edge thereof, and in which is included an elongated plate having a first end for being attached to said first end of said body and having a second end for being attached to said second end of said body, said plate being attached to said body adjacent said second edge thereof.

4. The wrench of claim 3 in which said first pivot means is used to pivotally attach said first end of said plate to said first end of said body, and in which said second pivot means is used to pivotally attach said second end of said plate to said second end of said body.

5. The wrench of claim 4 in which said first pivot means includes a pivot rod, in which said first end of said body has an aperture therein extending between said first and second edges thereof for receiving said pivot rod of said first pivot means, in which said lever has an aperture through said first end thereof for receiving said pivot rod of said first pivot means, and in which said plate has an aperture through said first end thereof for receiving said pivot rod of said first pivot means.

6. The wrench of claim 5 in which said second pivot means includes a pivot rod, in which said second end of said body has an aperture therethrough extending between said first and second edges thereof for receiving said pivot rod of said second pivot means, in which said lever has an aperture through said intermediate portion thereof for receiving said pivot rod of said second pivot means, and in which said plate has an aperture through said second end thereof for receiving said pivot rod of said second pivot means.

7. The wrench of claim 6 in which the distance between said apertures through said first end and said intermediate portion of said lever is substantially equal to the distance between said apertures through said first and second ends of said plate.

8. The wrench of claim 7 in which said first end of said body is turned back on itself to form said aperture therethrough and to reinforce said body.

9. The wrench of claim 8 in which said second edge of said body has a reinforcing plate attached thereto to reinforce said body, said aperture through said second end of said body being formed by said reinforcing plate.

* * * * *